US005599780A

United States Patent [19]

Koyama et al.

[11] Patent Number: 5,599,780

[45] Date of Patent: Feb. 4, 1997

[54] METAL WORKING OIL COMPOSITION

[75] Inventors: Sabro Koyama; Tahei Okada, both of Ichihara; Yoshiaki Aiki, Omiya, all of Japan

[73] Assignee: Idemitsu Kosan Co., Ltd., Tokyo, Japan

[21] Appl. No.: 544,920

[22] Filed: Oct. 18, 1995

Related U.S. Application Data

[63] Continuation of Ser. No. 260,795, Jun. 16, 1994, abandoned.

[30] Foreign Application Priority Data

Jul. 2, 1992 [JP] Japan ..... 5-164334

[51] Int. Cl.[6] ..... C10M 125/22

[52] U.S. Cl. ..... 508/391; 508/398

[58] Field of Search ..... 252/33, 333; 508/391, 508/398; C10M 127/02

[56] References Cited

U.S. PATENT DOCUMENTS

| | | | |
|---|---|---|---|
| 3,852,204 | 12/1974 | Souillard et al. | 252/33.4 |
| 4,155,859 | 5/1979 | Higgins . | |
| 4,659,488 | 4/1987 | Vinci | 252/33 |
| 5,352,373 | 10/1994 | Goto | 252/18 |

FOREIGN PATENT DOCUMENTS

| | | |
|---|---|---|
| 0075411 | 3/1983 | European Pat. Off. . |
| 0094144 | 11/1983 | European Pat. Off. . |
| 0369320 | 5/1990 | European Pat. Off. . |
| 0484542 | 5/1992 | European Pat. Off. . |
| 1358965 | 5/1974 | United Kingdom . |

*Primary Examiner*—Stephen Kalafut
*Assistant Examiner*—Cephia D. Toomer
*Attorney, Agent, or Firm*—Antonelli, Terry, Stout & Kraus, LLP

[57] ABSTRACT

A metal working oil composition having a kinematic viscosity of 20 cSt or less at a temperature of 40° C. is herein disclosed which comprises (A) 10% by weight or more of an n-α-olefin (e.g. 1-hexadecene) and (B) an overbased sulfonate having a total base number of 350 mg·KOH/g or more in such an amount that the total base number of the composition is 12.5 mg·KOH/g or more. The metal working oil composition is particularly suitable as a press lubricant for aluminum alloys, has an excellent mass workability, and is more excellent in coating workability, lubricity, degreasing properties, weldability, etc. than a conventional solid coating type lubricant.

10 Claims, No Drawings

METAL WORKING OIL COMPOSITION

This application is a Continuation application of application Ser. No. 260,795, filed Jun. 16, 1994, now abandoned.

BACKGROUND OF THE INVENTION

1. Field of the Invention

The present invention relates to a novel metal working oil composition. More specifically, it relates to a metal working oil composition which is particularly suitable as a press lubricant for aluminum alloys and which is more excellent in coating workability, lubricity, degreasing properties, weldability and the like than a conventional solid coating type lubricant.

2. Description of the Related Art

In recent years, high-strength aluminum alloys have admirably been used as materials for parts of cars, rolling stocks, ships, airplanes and the like from the viewpoint of weight lightening which leads to fuel saving. Since these high-strength aluminum alloys are poor in plastic workability, an acrylic polymer-based or a wax-based solid coating type lubricant has usually been used as a working lubricant.

However, the solid coating type lubricant is poor in mass workability and insufficient in coating workability, lubricity, degreasing properties and weldability in view of (1) that a coating system (a roll coater and a drying step) is additionally required to be installed in a plate manufacturing process, (2) that the coating film is liable to partially peel by contact peeling and blocking, and the partial peeling is not restorable, which causes press failure, (3) that a degreased film floats in a tank, and in consequence, the service life of a degreasing liquid is shortened, and (4) that welding failure is more liable to occur as compared with an oil system (particularly in the case of a resin coating type).

If a liquid press lubricant having a low viscosity is developed which can solve the above-mentioned problems of the conventional solid coating type lubricant and which is excellent in mass workability, the aluminum materials can be applied to car bodies and the like by the use of this liquid press lubricant, whereby the liquid press lubricant can contribute to an industrial field in points of energy saving and the like.

SUMMARY OF THE INVENTION

Under such circumstances, an object of the present invention is to provide a low-viscosity metal working oil composition having an excellent mass workability which is particularly suitable as a press lubricant for aluminum alloys and which is more excellent in coating workability, lubricity, degreasing properties, weldability and the like than a conventional solid coating type lubricant.

The present inventors have intensively researched with the intention of developing the metal working oil composition having the above-mentioned preferable characteristics, and as a result, it has been found that the above-mentioned object can be achieved by a low-viscosity composition containing an n-α-olefin and an overbased sulfonate in a specific ratio. The present invention has been completed on the basis of such a knowledge.

That is to say, the present invention is directed to a metal working oil composition having a kinematic viscosity of 20 cSt or less at a temperature of 40° C. which comprises (A) 10% by weight or more of an n-α-olefin and (B) an overbased sulfonate having a total base number of 350 mg·KOH/g or more in such an amount that the total base number of the composition is 12.5 mg·KOH/g or more.

DETAILED DESCRIPTION OF THE INVENTION

In the composition of the present invention, an n-α-olefin which can be used as a component (A) preferably has 10 to 20 carbon atoms. The n-α-olefin having less than 10 carbon atoms is not preferable because of being noticeably volatile, and on the other hand, the n-α-olefin having more than 20 carbon atoms is not preferable, because it easily solidifies or precipitates and the composition obtained therefrom is poor in storage stability. Furthermore, the content of the n-α-olefin is required to be 10 wt % or more based on the total weight of the composition. If this content is less than 10 wt %, scuffing tends to occur at the time of press work.

Typical preferable examples of the n-α-olefin include 1-decene, 1-dodecene, 1-tetradecene, 1-hexadecene, 1-octadecene, 1-eicosene and mixtures thereof. As the n-α-olefin, an olefin obtained by any of various methods can be used, and for example, an ethylene oligomer obtained by. polymerizing ethylene in a usual manner can be used.

An overbased sulfonate which can be used as a component (B) has a total base number of 350 mg·KOH/g or more, preferably 350–600 mg·KOH/g. If this total base number is less than 350 mg·KOH/g, degreasing properties and weldability tend to deteriorate. Examples of the overbased sulfonate include sodium salts, calcium salts, barium salts and magnesium salts, and they may be used singly or in a combination of two or more thereof. Above all, the calcium salts and the sodium salts are preferable. The amount of the overbased sulfonate is determined so that the total base number of the composition may be 12.5 mg·KOH/g or more, preferably in the range of 12.5 to 200 mg·KOH/g. If the total base number of the composition is less than 12.5 mg·KOH/g, the object of the present invention cannot sufficiently be attained. Conversely, if it is more than 200 mg·KOH/g, the degreasing properties and weldability tend to unpreferably deteriorate.

To the metal working oil composition of the present invention, a base oil such as a mineral oil or a hydrocarbon-based synthetic oil can be added, if necessary. The preferable base oil has a kinematic viscosity in the range of 1 to 1,000 cSt at a temperature of 40° C. As the mineral oil, various oils are usable, and examples of the mineral oil include a distilled oil which can be obtained by distilling a paraffinic crude oil, an intermediate crude oil or a naphthenic crude oil under atmospheric pressure, or by distilling, under reduced pressure, a residual oil at the time of distillation under atmospheric pressure, and a refined oil obtained by refining this distilled oil. Examples of the refined oil include a solvent-refined oil, a hydrogenation-refined oil, a dewaxed oil and a clay-treated oil. On the other hand, examples of the hydrocarbon-based synthetic oil include a low-molecular weight polybutene, a low-molecular weight polypropylene, oligomers of α-olefin having 8 to 14 carbon atoms and hydrides thereof, alkylbenzenes, and alkylnaphthalenes. These mineral oils and synthetic oils may be used singly or in a combination of two or more thereof. In addition, it is preferable to add 20 to 60% by weight of the highly refined base oil having a kinematic viscosity of 30 to 800 cSt at a temperature of 40° C., for example, the mineral oil having a sulfur content of 500 ppm or less, preferably 100 ppm or less treated by a hydrogenation-refining process and/or a (co)polymer of an olefin, because the employment of the highly refined base oil inhibits the generation of stains and rust on worked articles.

The metal working oil composition of the present invention is required to have a kinematic viscosity of 20 cSt or less at a temperature of 40° C. If this kinematic viscosity is in excess of 20 cSt, the handling properties of plate cutting in a plate press work step and the degreasing properties of pressed parts deteriorate. Additionally, in the composition of the present invention, a product of the content (wt %) of the n-α-olefin by the total base number (mg·KOH/g) of the composition is preferably 1,200 or more. If this product is less than 1,200, the object of the present invention cannot be sufficiently achieved.

Furthermore, if necessary, various additives can be added to the metal working oil composition of the present invention, so long as the object of the present invention is not impaired. Examples of the additives include various known oiliness agents and extreme pressure agents such as alcohols, fatty acids, esters, diesters, polyvalent esters, fats and oils, sulfurized fats and oils, sulfurized esters, sulfurized olefins, chlorinated paraffins, phosphates, phosphites, dithiophosphates (zinc dithiophosphate, molybdenum dithiophosphate and the like), and dithiocarbamates (molybdenum dithiocarbamate and the like). In addition, various known emulsifying agents, rust preventives, corrosion inhibitors, anti-foaming agents and the like can also be suitably added.

The metal working oil composition of the present invention is more excellent in coating workability, lubricity, degreasing properties, weldability and the like than a conventional solid coating type lubricant, and it is particularly suitable as a press oil for aluminum alloys.

Next, the present invention will be described in more detail with reference to examples, but the scope of the present invention shall not be limited to these examples at all.

The performance of each working oil was evaluated in accordance with the following procedures.

(1) Draw bead drawing force

A test piece was put between a block provided with a lug corresponding to a draw bead and another block facing thereto and having grooves, and a predetermined pressing force was then applied thereto by oil pressure. Afterward, the test piece was drawn, and at this time, a drawing force was measured, on the basis of which press moldability was evaluated.

Material used: 5182-O (made by Kobe Steel, Ltd.), 25×300 mm, strip shape

| | |
|---|---|
| Bead shape (tip portion R): | 2 mm |
| Bead height (lug): | 3 mm |
| Press load: | 400 kg, 1,000 kg |
| Drawing velocity: | 100 mm/min |

A gauze was impregnated with a lubricant, and the test piece was then coated with the lubricant using the guaze. The amount of the lubricant coated was 1.5 g/m$^2$ in the case of an oily type or 9.0 g/m$^2$ in the case of a wax coat agent.

(2) Degreasing properties

A test piece was immersed in a 3 wt % Lidolin SD 400 solution at 60° C. for 2 minutes, and a water wetting ratio was then measured. The degreasing properties were evaluated in accordance with the following criterion:

⊙: A case where the water wetting ratio was not less than 90%.

○: A case where the water wetting ratio was in the range of less than 90% to not less than 70%.

Δ: A case where the water wetting ratio was in the range of less than 70% to not less than 40%.

X: A case where the water wetting ratio was less than 40%.

Examples 1 to 11 and Comparative Examples 1 to 11

Metal working oil compositions shown in Table 1 were prepared, and physical properties and performances of these compositions were then determined. The results are shown in Table 2.

TABLE 1

| | Composition (wt %) | | | | | |
|---|---|---|---|---|---|---|
| | Mineral Oil | | n-α-olefin | | Sulfonate | |
| | Kind | Amount | Kind | Amount | Kind | Amount |
| Example 1 | — | — | $C_{16}$ | 97.5 | 500 TBN (Ca) | 2.5 |
| Example 2 | Bright Stock | 45 | $C_{16}$ | 50 | 500 TBN (Ca) | 5 |
| Example 3 | Bright Stock | 60 | $C_{16}$ | 30 | 500 TBN (Ca) | 10 |
| Example 4 | Bright Stock | 40 | $C_{16}$ | 50 | 500 TBN (Ca) | 10 |
| Example 5 | — | — | $C_{16}$ | 90 | 500 TBN (Ca) | 10 |
| Example 6 | — | — | $C_{16}$ | 80 | 500 TBN (Ca) | 20 |
| Example 7 | Bright Stock | 20 | $C_{16}$ | 60 | 500 TBN (Ca) | 20 |
| Example 8 | 60 Neutral Oil | 40 | $C_{16}$ | 40 | 500 TBN (Ca) | 20 |
| Example 9 | — | — | $C_{16}$ | 60 | 500 TBN (Ca) | 40 |
| Example 10 | Bright Stock | 40 | $C_{16}$ | 40 | 500 TBN (Ca) | 20 |
| Example 11 | Bright Stock | 40 | $C_{16}$ | 50 | 400 TBN (Na) | 10 |
| Comp. Ex. 1 | Wax Coat | | | | | |
| Comp. Ex. 2 | Milbond | | | | | |
| Comp. Ex. 3 | Bright Stock | 90 | — | — | 500 TBN (Ca) | 10 |
| Comp. Ex. 4 | Bright Stock | 80 | — | — | 500 TBN (Ca) | 20 |
| Comp. Ex. 5 | — | — | $C_{16}$ | 100 | — | — |
| Comp. Ex. 6 | Bright Stock | 50 | $C_{16}$ | 50 | — | |
| Comp. Ex. 7 | Bright Stock | 70 | $C_{16}$ | 10 | 500 TBN (Ca) | 20 |
| Comp. Ex. 8 | Bright Stock | 48 | $C_{16}$ | 50 | 500 TBN (Ca) | 2 |
| Comp. Ex. 9 | Bright stock | 85 | $C_{16}$ | 5 | 500 TBN (Ca) | 10 |
| Comp. Ex. 10 | — | — | $C_{16}$ | 50 | 100 TBN (Ca) | 50 |
| Comp. Ex. 11 | Bright Stock | '33.3 | $C_{16}$ | 50 | 300 TBN (Ca) | 16.7 |

TBN: Total base number (mg · KOH/g).

TABLE 2

| | Physical Properties and Performance of Working Oil Composition | | | | | |
|---|---|---|---|---|---|---|
| | Kinematic | | Draw Bead Drawing Force | | | |
| | Viscosity at 40° C. (cSt) | TBN (mg KOH/g) | α-olefin content × TBN | Load 400 kg | Load 1000 kg | Degreasing Properties |
| Example 1 | 3.1 | 12.5 | 1219 | 365 | 450 | ⊙ |
| Example 2 | 11.0 | 25 | 1250 | 365 | 470 | ⊙ |
| Example 3 | 7.3 | 50 | 1500 | 360 | 450 | ⊙ |
| Example 4 | 11.7 | 50 | 2500 | 360 | 440 | ⊙ |
| Example 5 | 3.8 | 50 | 4500 | 345 | 430 | ⊙ |
| Example 6 | 5.3 | 100 | 8000 | 345 | 430 | ⊙ |
| Example 7 | 10.8 | 100 | 6000 | 335 | 420 | ⊙ |
| Example 8 | 8.6 | 100 | 4000 | 345 | 430 | ⊙ |
| Example 9 | 12.9 | 200 | 12000 | 335 | 420 | ○ |
| Example 10 | 11.3 | 100 | 4000 | 335 | 425 | ⊙ |
| Example 11 | 11.9 | 40 | 2000 | 360 | 440 | ⊙ |
| Comp. Ex. 1 | — | — | — | 360 | 440 | X |
| Comp. Ex. 2 | — | — | — | 380 | 440 | X |
| Comp. Ex. 3 | 425 | 50 | — | 400 | Broken | X |
| Comp. Ex. 4 | 425 | 100 | — | 390 | 510 | X |
| Comp. Ex. 5 | 2.6 | 0 | — | 390 | 510 | ⊙ |
| Comp. Ex. 6 | 11.0 | 0 | — | 380 | Broken | ⊙ |
| Comp. Ex. 7 | 297.6 | 100 | 1000 | 380 | 460 | X |
| Comp. Ex. 8 | 11.2 | 10 | 500 | 380 | Broken | ⊙ |
| Comp. Ex. 9 | 380 | 50 | 250 | 380 | Broken | X |
| Comp. Ex. 10 | 3.7 | 50 | 2500 | 370 | 480 | Δ |
| Comp. Ex. 11 | 16.5 | 50 | 2500 | 360 | 450 | Δ |

TBN: Total base number (mg · KOH/g).

What is claimed is:

1. A metal working oil composition for pressing aluminum or an alloy thereof, having a kinematic viscosity of 20 cSt or less at a temperature of 40° C. which comprises (A) 10% by weight or more of an n-α-olefin having 10 to 20 carbon atoms and (B) an overbased sulfonate having a total base number of 350 to 600 mg·KOH/g or more in such an amount that the total base number of the composition is 12.5 to 200 mg·KOH/g or more and a product of the content (wt %) of the n-α-olefin by the total base number (mg·KOH/g) of the composition is 1,200 or more; the upper amount of the overbased sulfonate being 20% by weight based on the total amount of the composition.

2. The metal working oil composition according to claim 1 wherein the n-α-olefin is selected from the group consisting of 1-decene, 1-dodecene, 1-tetradecene, 1-hexadecene, 1-octadecene, 1-eicosene and mixtures thereof.

3. The metal working oil composition according to claim 1 wherein the overbased sulfonate is selected from the group consisting of sodium salts, calcium salts, barium salts and magnesium salts.

4. The metal working oil composition according to claim 3 wherein the overbased sulfonate is a calcium salt or a sodium salt.

5. The metal working oil composition according to claim 1 which further comprises a base oil.

6. The metal working oil composition according to claim 5 wherein the base oil is selected from the group consisting of a mineral oil and a hydrocarbon-based synthetic oil.

7. The metal working oil composition according to claim 6 wherein the mineral oil is selected from the group consisting of a solvent-refined oil, a hydrogenation-refined oil, a dewaxed oil and a clay-treated oil.

8. The metal working oil composition according to claim 6 wherein the hydrocarbon-based synthetic oil is selected from the group consisting of a low-molecular weight polybutene, a low-molecular weight polypropylene, oligomers of α-olefin having 8 to 14 carbon atoms and hydrides thereof, alkylbenzenes, and alkylnaphthalenes.

9. A metal working oil composition for pressing aluminum or an alloy thereof, having a kinematic viscosity of 20 cSt or less at a temperature of 40° C. which comprises (A) 10% to 97.5% by weight of an n-α-olefin having 10 to 20 carbon atoms based on the total amount of the composition and (B) from 2.5 to 20% by weight of an overbased sulfonate based on the total amount of the composition, said sulfonate having a total base number of 350 to 600 mg·KOH/g or more so that the total base number of the composition is 12.5 to 200 mg·KOH/g or more and a product of the content (wt %) of the n-α-olefin by the total base number (mg·KOH/g) of the composition is 1200 or more; and from 0 to 87.5% by weight of a base oil.

10. The metal working oil composition according to claim 9, which further contains at least one additive selected from the group consisting of oiliness agent, extreme pressure agent, emulsifying agent, rust preventive, corrosion inhibitor and anti-foaming agent.

* * * * *